US009948049B2

(12) United States Patent
Stone

(10) Patent No.: US 9,948,049 B2
(45) Date of Patent: Apr. 17, 2018

(54) STARTER POST RELOCATION ASSEMBLY

(71) Applicant: Montgomery R. Stone, Valley View, TX (US)

(72) Inventor: Montgomery R. Stone, Valley View, TX (US)

(73) Assignee: PACCAR Inc, Bellevue, WA (US)

( * ) Notice: Subject to any disclaimer, the term of this patent is extended or adjusted under 35 U.S.C. 154(b) by 0 days.

(21) Appl. No.: 15/098,137

(22) Filed: Apr. 13, 2016

(65) Prior Publication Data

US 2017/0302041 A1 Oct. 19, 2017

(51) Int. Cl.
*B61G 5/10* (2006.01)
*H01R 31/06* (2006.01)
*H01R 4/30* (2006.01)

(52) U.S. Cl.
CPC ..... *H01R 31/06* (2013.01); *H01R 4/30* (2013.01)

(58) Field of Classification Search
CPC ..... H01R 11/24; H01R 4/5025; H01R 4/308; H01R 33/94; H01R 33/22; B61G 5/10; Y02E 60/12
USPC ..... 439/503, 504, 500, 641, 638, 805
See application file for complete search history.

(56) References Cited

U.S. PATENT DOCUMENTS 2,468,785 A * 5/1949 Sealey ..... H01R 4/56 174/94 S
4,054,355 A 10/1977 Kourimsky et al.
4,955,823 A * 9/1990 Luzzi ..... H01R 13/53 439/507
4,969,834 A * 11/1990 Johnson ..... H01R 13/6691 320/105
5,092,798 A * 3/1992 Muench ..... H01R 13/53 174/152 R
5,487,679 A * 1/1996 Quaintance ..... H01R 4/5033 24/136 B
6,764,353 B2 7/2004 Freitag
6,850,412 B2 * 2/2005 Peter ..... H05K 5/0013 174/377
7,018,233 B1 * 3/2006 Griffin, III ..... H01R 31/065 439/504

(Continued)

FOREIGN PATENT DOCUMENTS

CN 204597009 U 8/2015
DE 102 28 612 A1 1/2003

(Continued)

*Primary Examiner* — Gary Paumen
(74) *Attorney, Agent, or Firm* — Christensen O'Connor Johnson Kindness PLLC

(57) ABSTRACT

An electrical post relocation assembly is configured for use with an electrical component of a vehicle. The electrical component includes a first and second components post configured to be coupled to first and second cables, respectively. The electrical post relocation has first and second relocation posts. The first relocation post is formed from a first electrical conductor and has a first end configured to be coupled to the first component post. A second end of the first relocation post is configured to be coupled to the first terminal fitting of the first cable. Similar to the first relocation post, the second relocation post is also formed from an electrical conductor. A first end of the second relocation post is configured to be coupled to the second component post, and a second end of the second relocation post is configured to be coupled to the second terminal.

14 Claims, 5 Drawing Sheets

(56) References Cited

U.S. PATENT DOCUMENTS

| | | | | |
|---|---|---|---|---|
| 7,364,457 | B2 * | 4/2008 | Mehki | H01R 11/282 439/34 |
| 7,819,704 | B1 * | 10/2010 | Su | H01R 24/28 439/131 |
| 8,021,184 | B1 * | 9/2011 | Patten, Jr. | H01R 4/5025 439/428 |
| 8,172,603 | B1 * | 5/2012 | Richardet, Jr. | H01R 11/24 439/504 |
| 2003/0039882 | A1 * | 2/2003 | Wruck | H01M 2/30 429/121 |
| 2006/0003627 | A1 | 1/2006 | Freitag | |
| 2012/0178286 | A1 * | 7/2012 | Schlaudroff | H01M 2/206 439/504 |
| 2015/0102692 | A1 | 4/2015 | Bae et al. | |
| 2015/0188117 | A1 | 7/2015 | Kim et al. | |

FOREIGN PATENT DOCUMENTS

| | | | |
|---|---|---|---|
| EP | 0 867 953 | A1 | 9/1998 |
| KR | 10-2015-0076761 | A | 7/2015 |

* cited by examiner

STARTER POST RELOCATION ASSEMBLY

BACKGROUND

During operation, four stroke internal combustion engines rely on inertia from one cycle to drive the engine through the first two strokes of the next cycle. More specifically, the third (combustion) stroke of one cycle drives the engine through the fourth (exhaust) stroke of that cycle, as well as the first (intake) and second (compression) strokes of the next cycle. When an engine is initially started, an external starter is utilized to drive the engine through the first two strokes.

FIG. 1 shows a known starter 50 for an internal combustion engine. The starter 50 includes a drive housing 52 and a solenoid 54. The starter 50 also includes a first electrical post 56 and a second electrical post 58 to connect the starter 50 to a battery (not shown) that powers the starter. In an exemplary embodiment, the first electrical post 56, referred to as the B-terminal, is connected in series between the positive battery terminal and a positive terminal on the vehicle alternator. The second electrical post 58, referred to as the ground terminal, is connected in series between the negative battery post and a negative terminal on the alternator.

It is desirable to be able to use common components on vehicles with different configurations. For engine components, this can prove difficult because space in the engine compartment is limited. Even when an alternate component can physically fit and be mounted within the space of the corresponding OEM part, limited access to component features, such as electrical connections may not be accessible. For example, it may be possible to mount a starter to an engine deigned to use a different starter, but the location of the electrical posts would make it difficult connect the electrical posts of the starter to the battery cables or other electrical connectors.

SUMMARY

A first representative embodiment of a disclosed electrical post relocation assembly is configured for use with an electrical component of a vehicle. The electrical component includes a first component post configured to be coupled to a first terminal fitting that is located on an end of a first cable. The electrical component also has a second post configured to be coupled to a second terminal fitting coupled to an end of a second cable. The electrical post relocation has first and second relocation posts. The first relocation post is formed from a first electrical conductor and has a first end configured to be coupled to the first component post. A second end of the first relocation post is configured to be coupled to the first terminal fitting of the first cable. Similar to the first relocation post, the second relocation post is also formed from an electrical conductor. A first end of the second relocation post is configured to be coupled to the second component post, and a second end of the second relocation post is configured to be coupled to the second terminal fitting.

A second representative embodiment of a disclosed electrical post relocation assembly is a starter post relocation assembly configured for use with an engine starter, wherein the starter has a positive post and a ground post. The starter post relocation assembly includes a bracket and first and second relocation posts coupled to the bracket. The first relocation post has a first end configured to be coupled to the positive post to provide an electrical connection between the first relocation post and the positive post. The first relocation post also has a second end configured to connect to a positive battery cable. The second relocation post has a first end configured to be coupled to the ground post to provide an electrical connection between the second relocation post and the ground post. The second end of the second relocation post is configured to connect to a ground battery cable.

This summary is provided to introduce a selection of concepts in a simplified form that are further described below in the Detailed Description. This summary is not intended to identify key features of the claimed subject matter, nor is it intended to be used as an aid in determining the scope of the claimed subject matter.

DESCRIPTION OF THE DRAWINGS

The foregoing aspects and many of the attendant advantages of this invention will become more readily appreciated as the same become better understood by reference to the following detailed description, when taken in conjunction with the accompanying drawings, wherein.

DETAILED DESCRIPTION

The detailed description set forth below in connection with the appended drawings, where like numerals reference like elements, are intended as a description of various embodiments of the present disclosure and are not intended to represent the only embodiments. Each embodiment described in this disclosure is provided merely as an example or illustration and should not be construed as precluding other embodiments. The illustrative examples provided herein are not intended to be exhaustive or to limit the disclosure to the precise forms disclosed. Similarly, any steps described herein may be interchangeable with other steps, or combinations of steps, in order to achieve the same or substantially similar result. Likewise, unless otherwise noted, any steps described herein are not limited to a particular order, such that steps may be rearranged in some instances to achieve the same or substantially similar result.

In the following description, specific details are set forth to provide a thorough understanding of exemplary embodiments of the present disclosure. It will be apparent to one skilled in the art, however, that the embodiments disclosed herein may be practiced without embodying all of the specific details. In some instances, well-known process steps have not been described in detail in order not to unnecessarily obscure various aspects of the present disclosure. Further, it will be appreciated that embodiments of the present disclosure may employ any combination of features described herein.

The present application may include references to directions, such as "forward," "rearward," "upper," "lower," "left," "right," etc. These references, and other similar directional references in the present application, are only to assist in helping describe and to understand the particular embodiment and are not intended to limit the present disclosure to these directions or locations.

Figure 1:
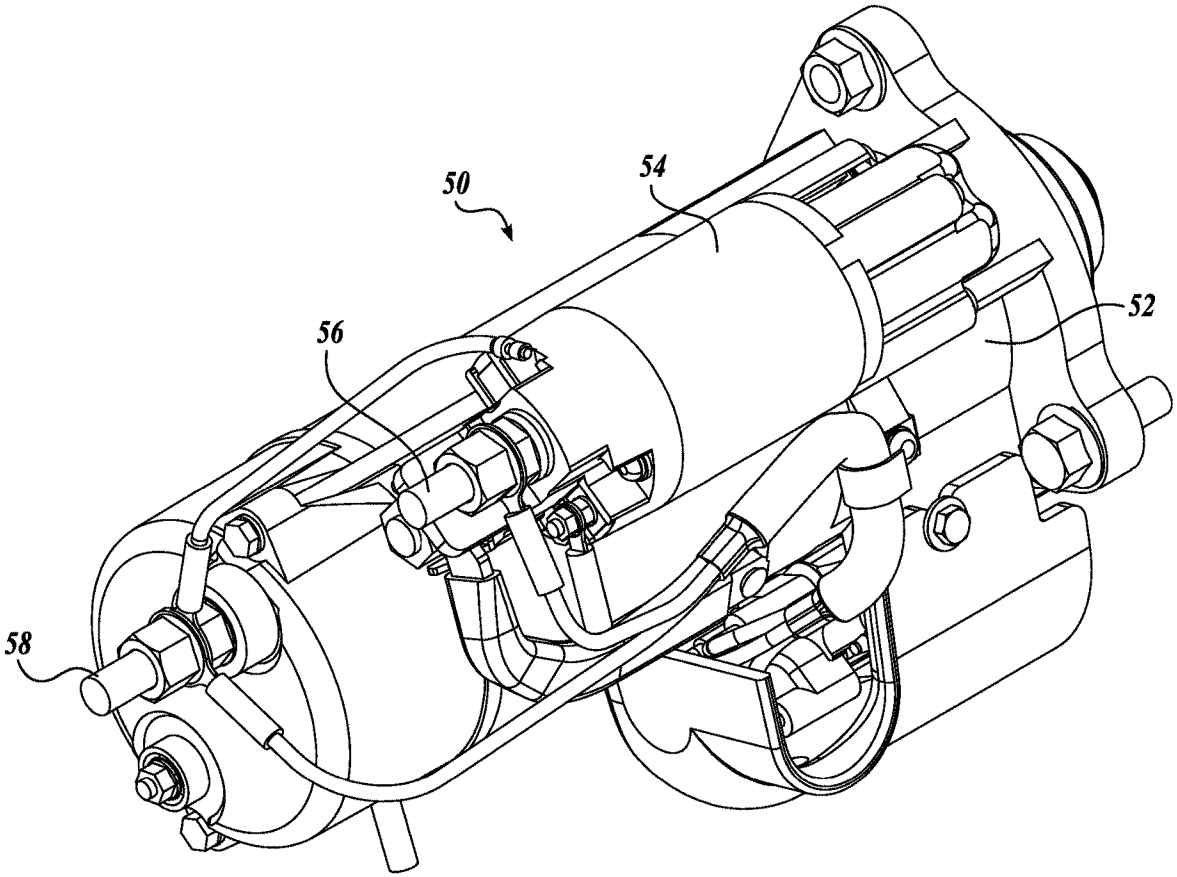
Fig. 1. (PRIOR ART)
FIG. 1 shows an isometric view of a known starter.
Figure 2:
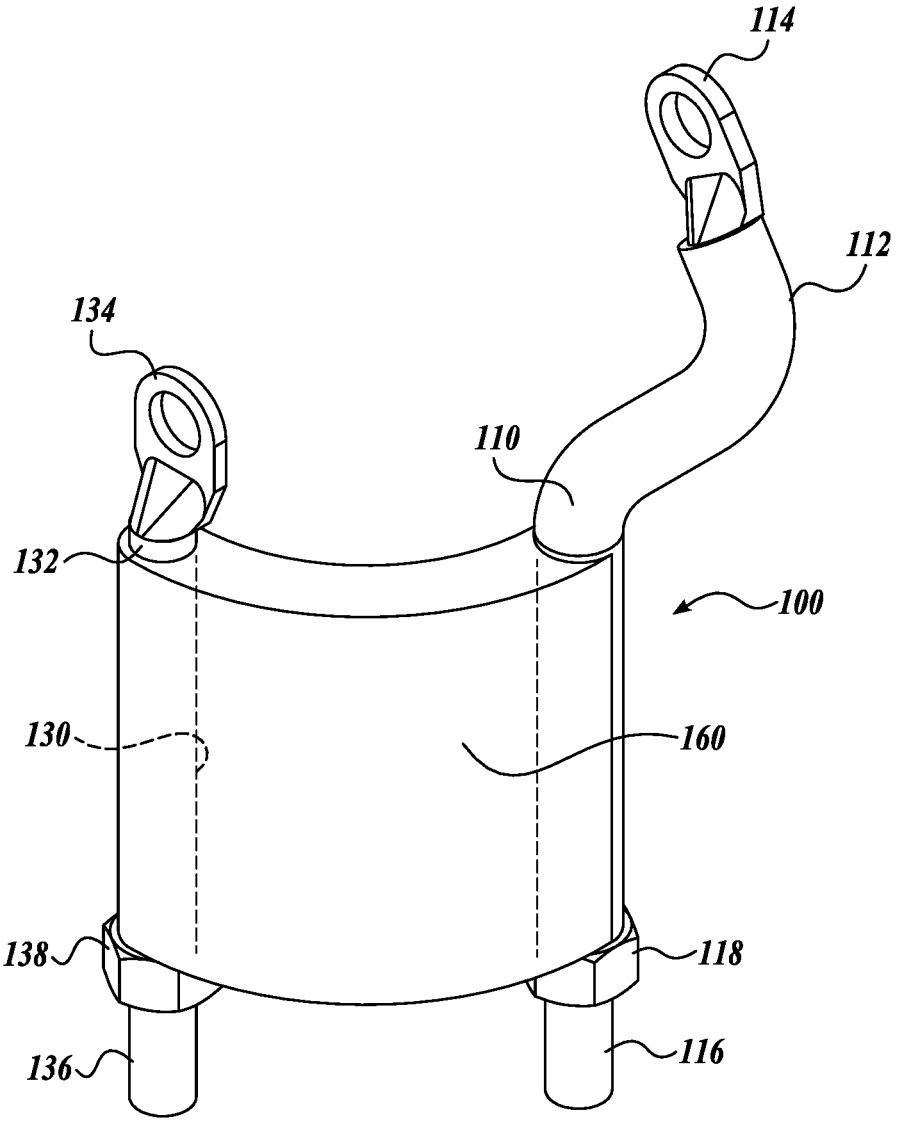
FIG. 2 shows an isometric view of a representative embodiment of a post relocation assembly according to the present disclosure.

Referring now to FIG. 2, a representative embodiment of a starter post relocation assembly 100 according to the present disclosure is shown. The relocation assembly 100 includes an elongate first relocation post 110. The first relocation post 110 is formed from an electrical conductor, such as copper, aluminum, or any other suitable material. The relocation post 110 is preferably formed from a bar having a circular cross-section; however, it will be appreciated that the relocation post may have cross-sections of other shapes, including square, rectangular, oval, or any other shape. A first end 112 of the first relocation post 110 has a lug connector 114 coupled thereto. The lug connector 114 is sized and configured to engage and be coupled to the first electrical post 56 of the starter 50. The disclosed configuration provides an electrical connection between the first relocation post 110 and the first electrical post 56.

In the illustrated embodiment, the first electrical post 56 is a threaded cylinder sized and configured to receive the lug connector 114, which is then secured to the post with a nut 70. In this manner, the first end 112 of the first relocation post 110 is attached to the first electrical post 56 in the same manner as a battery cable under a standard installation. It will be appreciated that the illustrated attachment of the first relocation post 110 to the first electrical post 56 is exemplary and should not be considered limiting. In this regard, any suitable configuration for coupling the first relocation post 110 to the first electrical post 56 to provide an electrical connection therebetween may be utilized. Further, the connection between the relocation post and the electrical post need not be similar to connection between the electrical post and a battery cable under standard installations. These and other attachment configurations are contemplated and should be considered within the scope of the present disclosure.

A second end 116 of the first relocation post 110 is a threaded cylinder sized and configured to be similar to the first electrical post 56 of the starter 50. In this manner, a terminal fitting 62 of a battery cable 60 that would be coupled to the first electrical post 56 under a standard installation can be coupled to the second end 116 of the first relocation post 110. In the illustrated embodiment, a first nut 118 is threaded on the second end 116 of the first electrical post 56, and the terminal fitting 62 is secured to the first electrical post between the first nut 118 and a second nut 74. In this manner, the battery cable 60 is electrically connected to the first relocation post 110, and, therefore, to the first electrical post 56.

Still referring to FIG. 2, the relocation assembly 100 also includes an elongate second relocation post 130, which is similar to the first relocation post 110. The second relocation post 130 is formed from an electrical conductor, such as copper, aluminum, or any other suitable material. The relocation post 130 is preferably formed from a bar having a circular cross-section; however, it will be appreciated that the relocation post may have cross-sections of other shapes, including square, rectangular, oval, or any other shape. A first end 112 of the first relocation post 110 has a lug connector 114 coupled thereto. A first end 132 of the second relocation post 130 has a lug connector 134 coupled thereto. The lug connector 134 is sized and configured to engage and be coupled to the second electrical post 58 of the starter 50. The disclosed configuration provides an electrical connection between the second relocation post 130 and the second electrical post 58.

In the illustrated embodiment, the second electrical post 58, like the first electrical post 56, is a threaded cylinder sized and configured to receive the lug connector 134, which is then secured to the post with a nut 72. In this manner, the first end 132 of the second relocation post 130 is attached to the second electrical post 58 in the same manner as a battery cable under a standard installation. It will be appreciated that the illustrated attachment of the second relocation post 130 to the second electrical post 58 is exemplary and should not be considered limiting. In this regard, any suitable configuration for coupling the second relocation post 130 to the second electrical post 58 to provide an electrical connection therebetween may be utilized. Further, the connection between the relocation post and the electrical post need not be similar to connection between the electrical post and a battery cable under standard installations. Also, the connections of the first and second ends of the second relocation post to the electric post, battery cable, or other component can differ from those of the first and second ends of the first relocation post. These and other attachment configurations are contemplated and should be considered within the scope of the present disclosure.

A second end 116 of the second relocation post 130 is a threaded cylinder sized and configured to be similar to the second electrical post 58 of the starter 50. In this manner, a terminal fitting 66 of a battery cable 64 that would be coupled to the first electrical post 56 under a standard installation can be coupled to the second end 136 of the second relocation post 130. In the illustrated embodiment, a first nut 138 is threaded on the second end 136 of the second electrical post 58, and the terminal fitting 66 is secured to the second electrical post between the first nut 138 and a second nut 76. In this manner, the battery cable 64 is electrically connected to the second relocation post 130, and, therefore, to the second electrical post 58.

The first and second relocation posts 110 and 130 are mounted to a fitting 160 that maintains the position of the relocation posts relative to each other. The fitting 160 also provides insulates the relocation posts 110 and 130 from each other to prevent a short. The fitting 160 is preferably made from a generally rigid material that does not conduct electricity; however, alternate materials that conduct electricity may be utilized in conjunction with insulating materials to electrically isolate the relocation posts from each other. Further, although the fitting 160 is preferably made from a rigid material, such as a hard polymer, alternate embodiments in which the fitting has some flexibility are contemplated. In this regard, the fitting 160 may be made from any material or combination of materials that maintain the position of the first relocation post 110 relative to the second relocation post 130, while also preventing an electrical connection between the first and second relocation posts.

Figure 3:
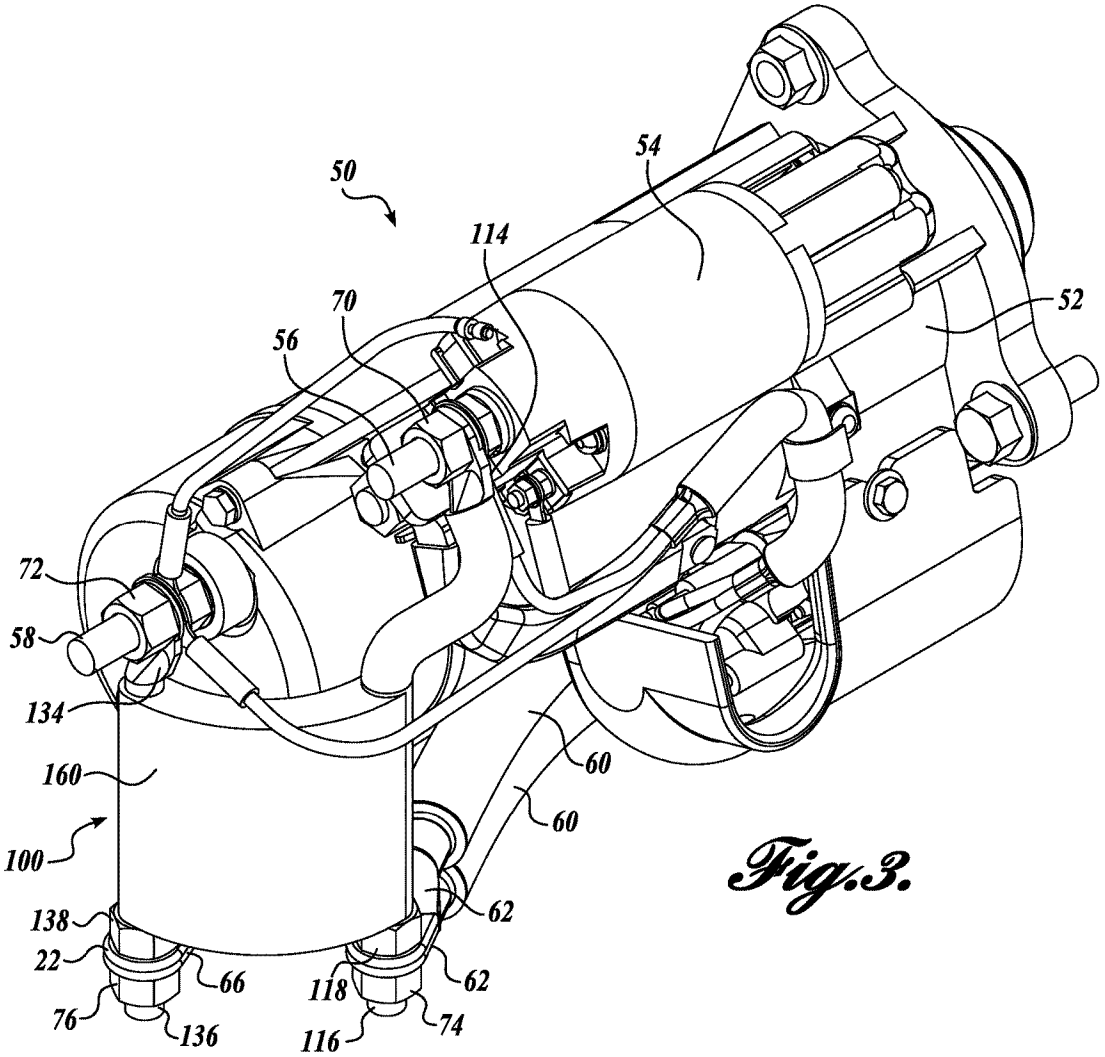
FIG. 3 shows a right isometric view of the starter of FIG. 1 with the post relocation assembly of FIG. 2.
Figure 4:
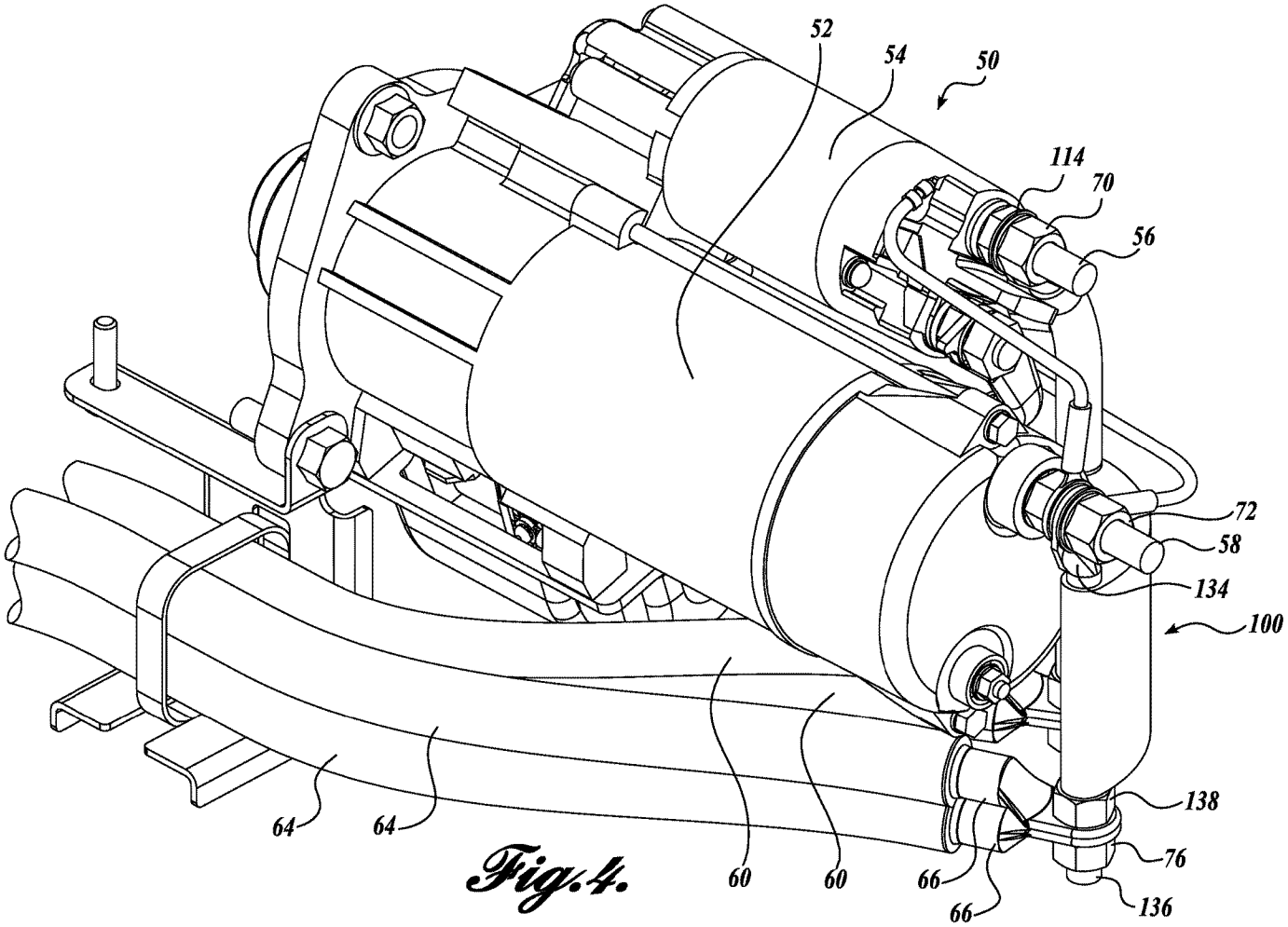
FIG. 4 shows a left isometric view of the starter of FIG. 1 with the post relocation assembly of FIG. 2.
Figure 5:
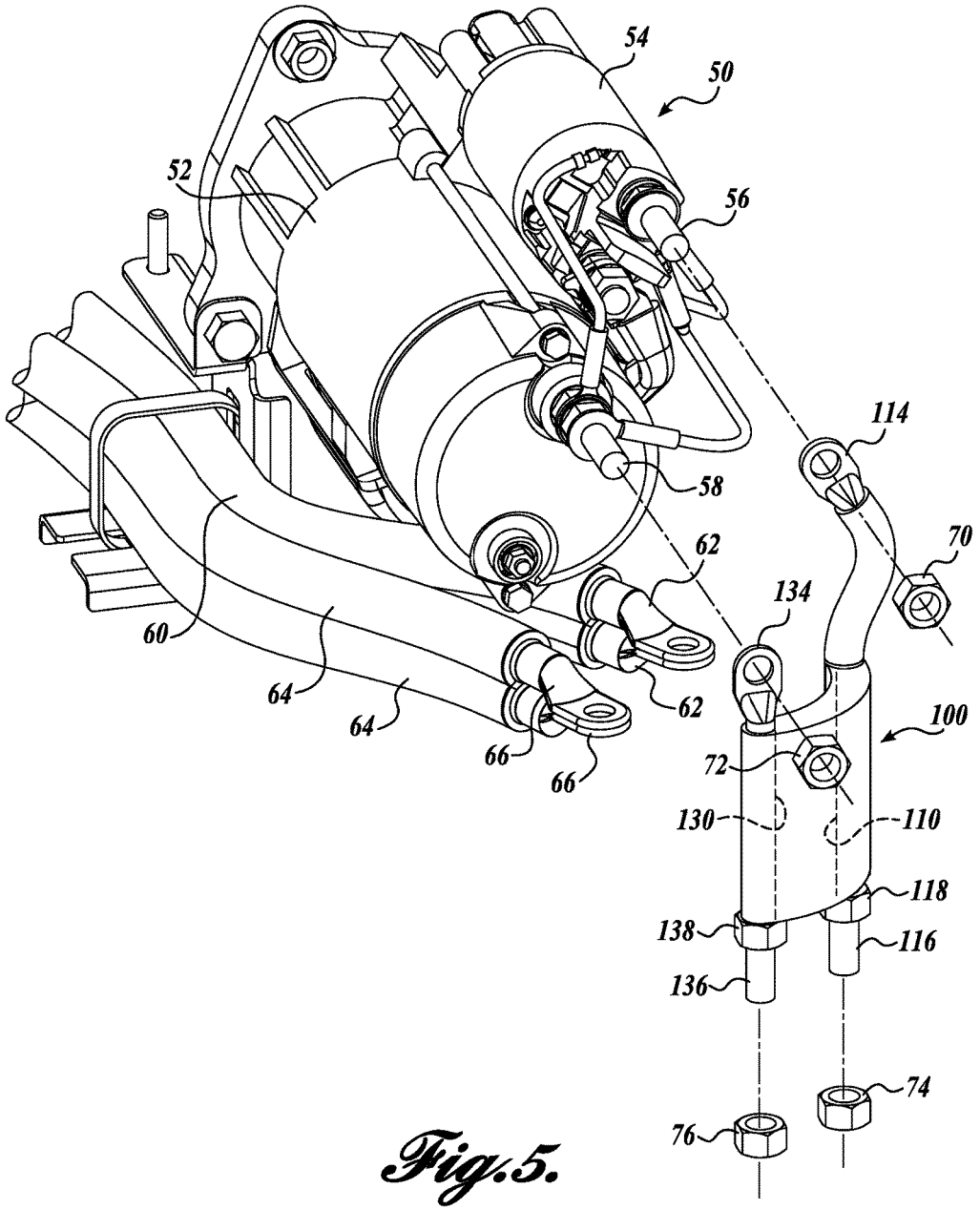
FIG. 5 shows a partially exploded right isometric view of the starter of FIG. 1 with the post relocation assembly of FIG. 2.

Referring now to FIGS. 3-5, the relocation assembly 100 is installed on the starter 50 by securing the first lug connector 114 to the B-terminal 56 with nut 70 while securing the second lug connector 134 to the ground terminal 58 with nut 72. With the lug connectors attached to the B-terminal 56 and ground terminal 58 (electrical posts), the rigid connector posts 110 and 130, in combination with the rigid fitting 160, position the second ends 116 and 136 of the first and second relocation posts 110 and 130, respectively, to be accessible to the ends of one or more battery cables. That is, the location of the battery cable attachment has been relocated from the electrical posts 56 and 58 of the starter 50 to the second ends 116 and 136 of the first and second connector posts 110 and 130, respectively.

The present disclosure describes a starter post relocation assembly. It should be appreciated that the disclosure is not limited to relocation assemblies for use with the starter of a vehicle engine. In this regard, alternate embodiments are contemplated for use with other electrical components for which it would be desirable to relocate one or more connection posts. Further, while the disclosed relocation assembly includes relocation posts having a lug connector at one end and a threaded cylinder at the other end, the present disclosure is not limited to such a configuration. Alternate configurations are contemplated wherein the first end of a relocation post is configured similar to an end of an electrical cable, and a second end of the relocation post is configured similar to the electrical post to which the electrical cable is normally attached. Additional embodiments are contemplated in which the ends of relocation posts are configured to be coupled in any suitable manner to the electrical posts and to the electrical cables and such embodiments should be considered within the scope of the present disclosure.

While illustrative embodiments have been illustrated and described, it will be appreciated that various changes can be made therein without departing from the spirit and scope of the invention.

The embodiments of the invention in which an exclusive property or privilege is claimed are defined as follows:

1. An electrical post relocation assembly configured for use with an electrical component of a vehicle, the electrical component having a first component post being configured to extend through and be coupled to a first lug terminal fitting disposed on an end of a first cable, the electrical component also having a second component post being configured to extend through and be coupled to a second lug terminal fitting disposed on an end of a second cable, the electrical post relocation assembly comprising:

(a) a first relocation post formed from a first electrical conductor, a third lug terminal fitting defining a first axis and being formed on a first end of the first relocation post the third lug terminal fitting being sized and configured to receive and be coupled to the first component post, a second end of the first relocation post defining a second axis and being sized and configured to be received by and coupled to the first lug terminal fitting; and (b) a second relocation post formed from a second electrical conductor, a fourth lug terminal fitting defining a third axis and being formed on a first end of the second relocation post the fourth lug terminal fitting being sized and configured to receive and be coupled to the second component post, a second end of the second relocation post defining a fourth axis and being sized and configured to be received by and coupled to the second lug terminal fitting, wherein the first axis is not parallel to the second axis.

2. The electrical post relocation assembly of claim 1, wherein the first electrical conductor is the same as the second electrical conductor.

3. The electrical post relocation assembly of claim 1, wherein the first electrical conductor is a rigid material.

4. The electrical post relocation assembly of claim 1, further comprising a bracket, the first and second relocation posts being coupled to the bracket.

5. The electrical post relocation assembly of claim 4, wherein the bracket electrically isolates the first relocation post from the second relocation post.

6. The electrical post relocation assembly of claim 1, wherein the third axis is not parallel to the fourth axis.

7. The electrical post relocation assembly of claim 6, wherein the second end of the first relocation post is configured to threadedly engage a nut.

8. A starter post relocation assembly configured for use with an engine starter having a positive post and a ground post, the starter post relocation assembly comprising:

(a) a bracket;

(b) a first elongate relocation post coupled to the bracket, the first relocation post having a first end with a first lug terminal fitting defining a first axis and being sized and configured to receive and to be coupled to the positive post to provide an electrical connection between the first relocation post and the positive post, a second end of the first relocation post defining a second axis being sized and configured to be received by and connect to a second lug terminal fitting disposed on an end of a positive battery cable; and (c) a second elongate relocation post coupled to the bracket, the second relocation post having a first end with a third lug terminal fitting defining a third axis and being sized and configured to be coupled to the ground post to provide an electrical connection between the second relocation post and the ground post, a second end of the second relocation post defining a fourth axis being configured to connect to a fourth lug terminal fitting disposed on an end of a ground battery cable, wherein the second axis is not parallel to the first axis.

9. The starter post relocation assembly of claim 8, wherein the first relocation post is formed from a first round bar comprising an electrical conductor.

10. The starter post relocation assembly of claim 9, wherein the second relocation post is formed from a second round bar comprising the electrical conductor.

11. The starter post relocation assembly of claim 8, wherein the fourth axis is not parallel to the third axis.

12. The starter post relocation assembly of claim 8, wherein the second end of the first relocation post is configured to threadedly engage a nut.

13. The starter post relocation assembly of claim 12, wherein the second end of the second relocation post is configured to threadedly engage a nut.

14. The starter post relocation assembly of claim 8, wherein the first and second relocation posts are formed of a rigid material.

* * * * *